US011603632B1

(12) United States Patent
Said

(10) Patent No.: US 11,603,632 B1
(45) Date of Patent: Mar. 14, 2023

(54) METHOD FOR PRODUCING A PRESTRESSED CONCRETE BRIDGE BEAM

(71) Applicant: AEEE Capital Holding & Advisory Group, Irvine, CA (US)

(72) Inventor: Mohamed J. Said, Irvine, CA (US)

( * ) Notice: Subject to any disclaimer, the term of this patent is extended or adjusted under 35 U.S.C. 154(b) by 224 days.

(21) Appl. No.: 17/145,456

(22) Filed: Jan. 11, 2021

(51) Int. Cl.
*E01D 2/04* (2006.01)
*E01D 101/28* (2006.01)

(52) U.S. Cl.
CPC ..... *E01D 2/04* (2013.01); *E01D 2101/28* (2013.01)

(58) Field of Classification Search
CPC .... E01D 2/02; E01D 2/04; E01D 2/00; E01D 2101/28; E01D 2101/262; E01D 2101/266; B28B 23/06; E04C 5/073; E04C 5/08
See application file for complete search history.

(56) References Cited

U.S. PATENT DOCUMENTS 840,053 A * 1/1907 Dunn ..... E04C 5/065 52/649.2
1,153,411 A * 9/1915 Wuczkowski ..... E04C 3/34 52/690
1,163,188 A * 12/1915 Waite ..... E04G 17/18 249/24
3,894,378 A * 7/1975 Needham ..... E04B 5/38 52/843
3,906,687 A * 9/1975 Schupack ..... E01D 19/02 52/378
4,185,440 A * 1/1980 Finsterwalder ..... B28B 23/046 29/469
4,912,896 A * 4/1990 Shamsai ..... E04C 3/26 52/432
5,144,710 A * 9/1992 Grossman ..... E01D 2/02 14/73
5,471,694 A * 12/1995 Meheen ..... E01D 15/127 14/73
6,557,201 B1 * 5/2003 Bowman ..... E01D 15/133 14/78
6,751,821 B1 * 6/2004 Han ..... E04C 3/26 52/223.8
7,475,446 B1 * 1/2009 He ..... E01D 2/04 52/223.7
8,020,235 B2 * 9/2011 Grace ..... E01D 2/02 14/78
8,316,495 B2 * 11/2012 He ..... E04B 5/046 52/223.7

(Continued)

*Primary Examiner* — Abigail A Risic
(74) *Attorney, Agent, or Firm* — Gugliotta & Gugliotta LPA

(57) ABSTRACT

A method for forming a hollow box-shaped cross section beam utilizes double walled trough that allows for prefabrication with pre-stressed concrete. The hollow box-shaped cross section precast beam is formed by filling the fabrication conduit with precast concrete. A number of tendons may be positioned within the fabrication conduit in quantities and positioned that are favorable to resist deflecting forces and provide anchoring forces within the hollow trough or box-shaped cross section precast beam formed therein. Further, a box shaped cross section bridge girder can be formed having no tensile stresses due to its own weight. The instant abstract is neither intended to define the invention disclosed in this specification nor intended to limit the scope of the invention in any way.

12 Claims, 2 Drawing Sheets

(56) References Cited

U.S. PATENT DOCUMENTS

| | | | | |
|---|---|---|---|---|
| 8,650,819 | B2 * | 2/2014 | Yegge | E04C 3/26 52/223.13 |
| 9,309,634 | B2 * | 4/2016 | Grace | E01D 2/02 |
| 9,988,775 | B1 * | 6/2018 | Garber | E01D 2/02 |
| 2005/0000186 | A1 * | 1/2005 | Van Erp | E01D 2/00 52/741.1 |
| 2006/0272267 | A1 * | 12/2006 | Mentado-Duran | E04C 3/26 52/693 |
| 2007/0056123 | A1 * | 3/2007 | Moon | E01D 2/02 14/77.1 |
| 2008/0302034 | A1 * | 12/2008 | Kang | E04C 3/26 52/223.14 |
| 2009/0241452 | A1 * | 10/2009 | Hillman | E01D 2/02 52/843 |
| 2010/0064454 | A1 * | 3/2010 | Grace | E01D 2/02 14/73 |
| 2010/0307081 | A1 * | 12/2010 | Han | E01D 2/00 52/223.7 |
| 2012/0279000 | A1 * | 11/2012 | Kim | E01D 21/00 14/77.1 |
| 2014/0109325 | A1 * | 4/2014 | Han | E04B 5/10 14/73 |
| 2016/0305077 | A1 * | 10/2016 | Shamsai | E04B 5/06 |
| 2017/0233961 | A1 * | 8/2017 | Tokuno | E01D 2/02 14/73 |
| 2019/0316305 | A1 * | 10/2019 | Thavamani Pandi | E01D 19/12 |
| 2021/0229319 | A1 * | 7/2021 | Royce | E04C 3/26 |

* cited by examiner

METHOD FOR PRODUCING A PRESTRESSED CONCRETE BRIDGE BEAM

RELATED APPLICATIONS

There are no previously filed, nor currently any co-pending applications, anywhere in the world.

BACKGROUND OF THE INVENTION

1. Field of the Invention

The present invention relates generally to concrete bridge beams and, more particularly, to an improved method for producing prestressed concrete bridge beams.

2. Description of the Related Art

Precast concrete beams are currently used in the construction of bridges and other related structures. A range of different beam type is commonly characterized by their cross section shape, i.e., T-beams, I-beams or box beams. Each has benefits depending on the particular structural application.

Box-shaped cross sections are much better suited to absorb bending and torsional stresses than trough-shaped cross sections. With a large proportion of the cross-section is located near the center of gravity, bending stress due to its own weight can be absorbed much better by a box-shaped cross-section than by other shaped cross-section. Although the use of such box beams allows for longer bridge spans and/or a reduced number of beams to provide a bridge of a particular width, such beams are heavier, complicating installation, and have a more complex geometry that complicates inspection, validation, maintenance, etc.

Consequently, a need exists for a method of producing such beam designs adapted for long span use in the construction of bridges or the like that allow for overall lighter prestressed concrete beams that allow for manufacturing off-site and delivered for final installations.

SUMMARY OF THE INVENTION

It is thus an object of the present invention to provide a box-beam bridge girder formed of prestressed concrete that is light enough to allow for manufacturing off-site and delivered on-site for final installation.

It is an object of the present invention to provide a two-step method for producing such prestressed concrete beams in which prefabricated hollow box-shaped cross section segments are assembled at the installation site and filled with reinforced concrete in-situ to form a bridge beam.

Briefly described according to a preferred embodiment of the present invention, a hollow box-shaped cross section beam is formed of prefabricated segments made of reinforced concrete. The hollow box is formed within a double walled trough that allows for prefabrication with prestressed concrete. The hollow box-shaped cross section precast beam may thereby be formed by filling the fabrication conduit with precast concrete. Preferably, the precast concrete includes a number of tendons (not shown) positioned within the fabrication conduit in quantities and positioned that are favorable to resist deflecting forces and provide anchoring forces within the hollow trough or box-shaped cross section precast beam formed therein.

An advantage of the present invention allows for a box shaped cross section bridge girder to be formed having no tensile stresses due to its own weight.

Another advantage of the present invention allows for a lesser overall weight of a trough-shaped or a box-shaped beam due to its hollow construction.

Further, beam designs may be adapted for long span use in the construction of bridges or the like using overall lighter prestressed concrete beams allow for manufacturing off-site and delivered for final installations.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
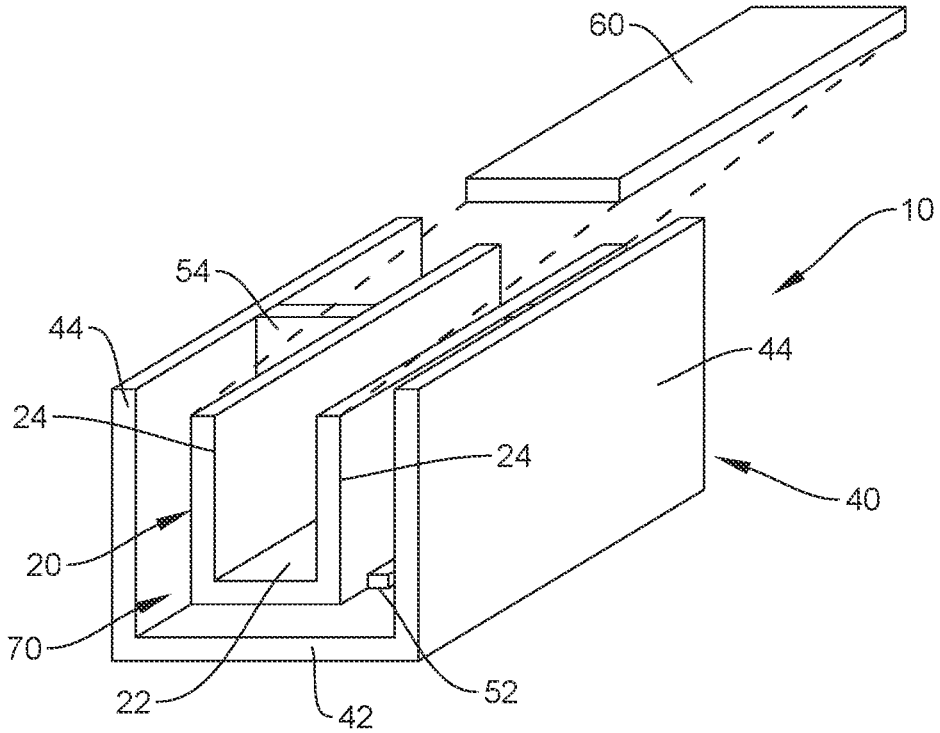
FIG. 1 is a partial exploded perspective view of a form for a hollow box-shaped cross section beam segment according to the preferred embodiment of the present invention.
Figure 2:
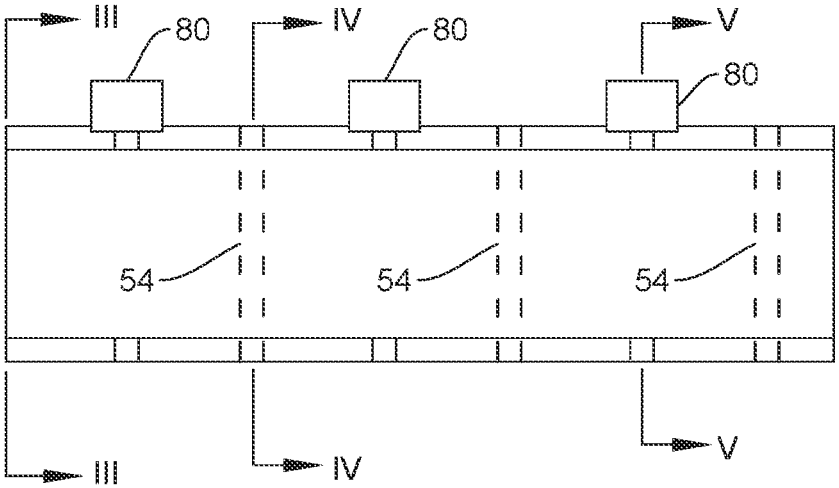
FIG. 2 is a side elevational view thereof.
Figure 3:
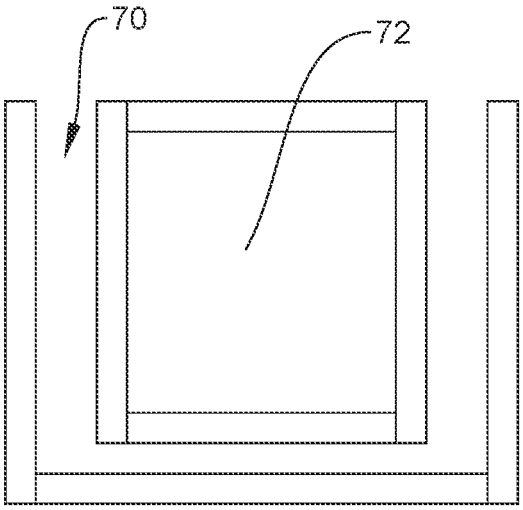
FIG. 3 is a cross section taken along section III-Ill of FIG. 2.
Figure 4:
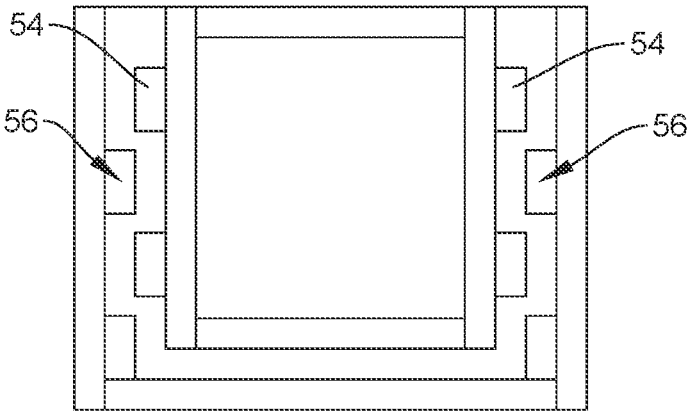
FIG. 4 is a cross section taken along section IV-IV of FIG. 2.
Figure 5:
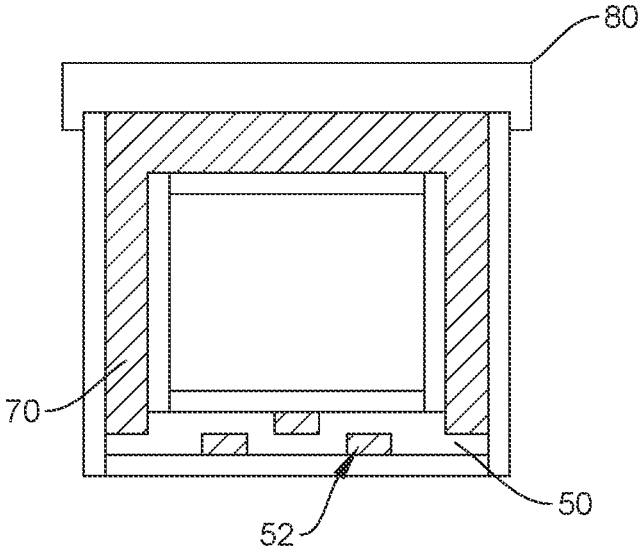
FIG. 5 is a cross section taken along section V-V of FIG. 2.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Referring now to the drawings, wherein like reference numerals indicate the same parts throughout the several views, a hollow box-shaped cross section precast beam is formed by a method using a form, generally noted as 10, according to the preferred embodiment of the present invention. The form 10 consists of an inner trough 20 positioned within an outer trough 40.

The inner trough 20 forms an internal conduit having a generally rectangular cross section formed by a reinforced concrete inner floor slab 22 at a lower end and two parallel and opposed reinforced concrete inner wall panels 24. The outer trough 40 forms an outer conduit wall similar having a generally rectangular cross section. The outer trough 40 is formed by a reinforced concrete outer floor slab 42 at a lower end and two parallel and opposed reinforced concrete outer wall panels 44. Preferably each slab and panel element may be formed of precast concrete. More preferably, each slab and panel element may be formed of pre-stressed precast concrete.

Once the outer trough 40 is created, the inner trough 20 is assembled therein. A plurality of floor supports 50 may be positioned along top of the outer floor slab 42. Each floor support 50 may be formed in a generally rectangular shape and supports the inner floor slab 22 parallel to and above the outer floor slab 42 by a first selected distance. Each floor support 50 may preferably form a number of access orifices 52 to allow for fluid communication throughout the fabrication conduit being formed, as will be described in greater detail below. Preferably each floor support 50 may be formed of precast concrete. More preferably, each floor support 50 may be formed of pre-stressed precast concrete.

To further create the inner trough 20, a plurality of wall supports 54 may be positioned against the outer wall panels 44 and providing a parallel, spaced support for the inner wall panels 42. Each wall support 54 may be formed in a generally rectangular shape and supports the inner wall panel 24 parallel to and offset and inward from the outer wall panel 44 by a second selected distance. Each wall support 54 may preferably may form a number of access orifices 56 to allow for fluid communication throughout the fabrication conduit being formed, as will be described in greater detail below. Preferably each wall support 54 may be formed of precast concrete. More preferably, each wall support 54 may be formed of pre-stressed precast concrete.

An upper slab 60 may further be supported at the top end of the inner wall slabs 24. The upper slab 60 thereby completes the separation of the fabrication conduit 70 and maintains a hollow inner conduit 72. Optionally an outer upper slab (not shown) may further be supported at the top end of the outer wall slabs 24. Preferably upper slab may be formed of precast concrete. More preferably, each upper slab may be formed of pre-stressed precast concrete.

Finally, an upper connection rib 80 may be provided about an upper terminus of the form 10 for providing a retention of the outer wall slabs 42 in an upright, fixed position. Preferably upper slab may be formed of precast concrete. More preferably, each upper slab may be formed of pre-stressed precast concrete.

2. Operation of the Preferred Embodiment

In operation, a hollow box-shaped cross section precast beam is formed within the form 10, with a plurality of such segments being formed end to end to create a desired overall box beam length. Each form 10 may be formed by positioning an outer floor slab 42 on a lower casting surface with an outer wall panel 44 positioned at each outer side terminus of the slab 42. A plurality of floor supports 50 may then be positioned about the upper surface of the lower slab 42. Next, a number of wall supports 54 may then be positioned along each wall panel 44. The supports 52, 54 may be positioned at selected intervals. The inner floor slab 22 is then placed within the trough on top of the floor supports. The inner wall panels 24 are then positioned at each outer side terminus of the slab 42. The upper slab 60 is then positioned about the upper terminus of the inner wall panels 24.

With the creation of the inner trough 20 within the outer trough 40, a fabrication conduit 70 is thereby formed. The inner trough 20 maintains a hollow inner conduit 72 separate from the fabrication conduit 70. Optionally an outer upper slab (not shown) may further be supported at the top end of the outer wall slabs 24, and the upper connection rib 80 place at the upper terminus of the form 10 for providing a retention of the outer wall slabs 42 in an upright, fixed position.

The thickness of the outer trough walls may be sufficient for facilitating the end application, which should be within the ability to determine by a person having ordinary skill in the relevant art in light of the present teachings. An exemplary thickness may be wall panels of about 2 inches thick and the floor slabs of about 4 inches thick. Further, the spacing between the inner trough 20 and the outer trough 40 may form a fabrication conduit 70 of a desired thickness. The thickness of the fabrication conduit 70 may be sufficient for facilitating the end application, which should be within the ability to determine by a person having ordinary skill in the relevant art in light of the present teachings. Preferably, the cross sectional area of the fabrication conduit 70 may be provided such that a desired moment of inertia and center of gravity are sufficient for the desired application when the fabrication conduit 70 is filled with a cementitious mix. Preferably, the fabrication conduit 70 will be filled with precast concrete. More preferably, the precast concrete will be pre-stressed to provide improved tensile and deflection strength. Even more preferably, a number of tendons (not shown) may be positioned within the fabrication conduit 70 in quantities and positioned that are favorable to resist deflecting forces and provide anchoring forces within the hollow trough or box-shaped cross section precast beam formed therein. Even still more preferably, a pre-stressing force applied to the tendons may be sufficient in order to ensure that the cross section in the center of the field of the bridge girder formed therein have no tensile stresses due to its own weight.

The overall weight of the trough-shaped or box-shaped beam, because of its hollow construction, may produce beam designs adapted for long span use in the construction of bridges or the like. The overall lighter prestressed concrete beams allow for manufacturing off-site and delivered for final installations.

As should be apparent to one having ordinary skill in the relevant art, in light of the present teachings, the production of an exemplary bridge girder with the method according to the above described invention may be used to form girders having different cross sectional shapes, i.e., rectangular, trapezoidal, U-shaped, T-shaped, etc. Further, the joining together of several segments may be provided to form a bridge girder of an extended length with a reduced number of lifting and tensioning processes which can accelerate the construction process.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as is suited to the particular use contemplated. It is intended that a scope of the invention be defined broadly by the Drawings and Specification appended hereto and to their equivalents.

What is claimed is:

1. A method for producing a prestressed, bridge girder with a hollow trough-shaped or box-shaped cross-section from prefabricated segments comprising:

creating an inner trough within an outer trough, wherein the inner trough forms a hollow inner conduit separate from a fabrication conduit between the inner trough and outer trough, wherein creating an inner trough within an outer trough utilizes a form comprising an inner trough positioned within an outer trough;

positioning a plurality of tensioning members within the fabrication conduit;

applying a tensioning force to the plurality of tensioning members;

filling the fabrication conduit with concrete;

curing said concrete; and releasing the tensioning force from the plurality of tensioning members, wherein said inner trough forms an internal conduit having a generally rectangular cross section formed by a reinforced concrete inner floor slab at a lower end and two parallel and opposed reinforced concrete inner wall panels; and said outer trough forms an outer conduit wall similar having a generally rectangular cross section formed by a reinforced concrete outer floor slab at a lower end and two parallel and opposed reinforced concrete outer wall panels;

wherein a plurality of floor supports positioned along a top of the outer floor slab supports the inner floor slab parallel to and above the outer floor slab by a first selected distance; and wherein a plurality of wall supports are positioned against the outer wall panels and providing a parallel, spaced support for the inner wall panels by a second selected distance.

2. The method of claim 1, wherein each floor support forms at least one access orifices allowing fluid communication throughout the fabrication conduit; and each wall support form at least one access orifice to allow for fluid communication throughout the fabrication conduit.

3. The method of claim 1, wherein said inner floor slab, said outer floor slab, said inner wall panels and said outer wall panels are each formed of precast concrete.

4. The method of claim 2, wherein said inner floor slab, said outer floor slab, said inner wall panels and said outer wall panels are each formed of precast prestressed concrete.

5. A precast, prestressed, bridge girder with a hollow trough-shaped or box-shaped cross-section made from the method of claim 1.

6. The bridge girder of claim 5, wherein the positioning of the plurality of tensioning members within the fabrication conduits are positioned to create the bridge girder having no tensile stresses due to its own weight.

7. A precast, prestressed, bridge girder with a hollow trough-shaped or box-shaped cross-section made from the method of claim 2.

8. The bridge girder of claim 7, wherein the positioning of the plurality of tensioning members within the fabrication conduits are positioned to create the bridge girder having no tensile stresses due to its own weight.

9. A precast, prestressed, bridge girder with a hollow trough-shaped or box-shaped cross-section made from the method of claim 3.

10. The bridge girder of claim 9, wherein the positioning of the plurality of tensioning members within the fabrication conduits are positioned to create the bridge girder having no tensile stresses due to its own weight.

11. A precast, prestressed, bridge girder with a hollow trough-shaped or box-shaped cross-section made from the method of claim 4.

12. The bridge girder of claim 11, wherein the positioning of the plurality of tensioning members within the fabrication conduits are positioned to create the bridge girder having no tensile stresses due to its own weight.

* * * * *